US006860751B1

(12) United States Patent
Huang

(10) Patent No.: US 6,860,751 B1
(45) Date of Patent: Mar. 1, 2005

(54) ELECTRICAL CONNECTOR ASSEMBLY

(76) Inventor: George Ying-Liang Huang, 8F, No. 435, Rei-Kuang Rd., Nei-Hu Dist., Taipei City (TW)

( * ) Notice: Subject to any disclaimer, the term of this patent is extended or adjusted under 35 U.S.C. 154(b) by 0 days.

(21) Appl. No.: 10/634,834

(22) Filed: Aug. 6, 2003

(51) Int. Cl.[7] ..... H01R 13/627
(52) U.S. Cl. ..... 439/362
(58) Field of Search ..... 439/362, 359, 439/361, 363–365, 740; 411/60.1, 80.1, 395, 396, 403

(56) References Cited

U.S. PATENT DOCUMENTS 5,647,758 A * 7/1997 Ichikawa et al. ..... 439/362
5,966,289 A * 10/1999 Hastings et al. ..... 439/362
6,116,942 A * 9/2000 Chen et al. ..... 439/362
2003/0073337 A1 * 4/2003 Guo ..... 439/362

* cited by examiner

*Primary Examiner*—P. Austin Bradley
*Assistant Examiner*—Felix O. Figueroa
(74) *Attorney, Agent, or Firm*—Liniak, Berenato & White, LLC

(57) ABSTRACT

An electrical connector assembly includes a first electrical connector having a fastening device with two fastening members, each of which has at least two first rib portions, and two biasing members, and a second electrical connector having two limiting members, each of which has at least one second rib portion. When the first and second electrical connectors are interconnected, each biasing member biases a respective one of the fastening members to press one of the first rib portions of the corresponding fastening member against the second rib portion of the corresponding limiting member, thereby arresting movement of the fastening members toward and away from the limiting members.

2 Claims, 4 Drawing Sheets

ELECTRICAL CONNECTOR ASSEMBLY

BACKGROUND OF THE INVENTION

1. Field of the Invention

The invention relates to an electrical connector assembly, more particularly to an electrical connector assembly that includes two electrical connectors which are interconnected by engagement of contact pins and pin holes.

2. Description of the Related Art

Referring to FIG. 1, a conventional electrical connector assembly is shown to comprise a first electrical connector 7 and a second electrical connector 8. The first electrical connector 7 includes an insulating first housing 71, an annular first metal shield 73 mounted on one end of the first housing 71, a first terminal unit disposed within the first metal shield 73, and two bolts 91 disposed respectively on two opposite sides of the first housing 71. The first terminal unit consists of a plurality of parallel contact pins 72. The second electrical connector 8 includes a second housing 81, an annular second metal shield 83 mounted on one end of the second housing 81, a blocking portion 84 connected to the second housing 81, a second terminal unit disposed on the second metal shield 83, and two nuts 92 disposed respectively on two opposite sides of the blocking portion 84. The second terminal unit consists of a plurality of pin holes 82 for insertion of the contact pins 72 therein. The first and second electrical connectors 7, 8 are interconnected through inter-engagement among the first and second metal shields 73, 83, the contact pins and pin holes 72, 82, and the bolts and nuts 91, 92.

However, in actual use, the bolts 91 are usually not completely threaded to the nuts 92 so that when the first electrical connector 7 is accidentally pushed or pulled, a small relative swinging movement will take place between the first and second electrical connectors 7, 8 that may result in separation of the same.

SUMMARY OF THE INVENTION

Therefore, the object of the present invention is to provide an electrical connector assembly that is capable of overcoming the aforementioned drawback of the prior art.

According to this invention, an electrical connector assembly comprises a first electrical connector and a second electrical connector. The first electrical connector has a first housing, a first terminal unit extending outwardly from the first housing, and a fastening device. The fastening device includes two fastening members that are disposed on the first housing and that are located on two sides of the first terminal unit, and two biasing members, each of which is disposed between the first housing and a respective one of the fastening members. Each of the fastening members has at least two first rib portions. The second electrical connector is disposed in front of and is connected electrically to the first electrical connector. The second electrical connector has a second housing, a second terminal unit that extends outwardly from the second housing and that is connected electrically and removably to the first terminal unit, and two limiting members disposed on the second housing and located on two sides of the second terminal unit. Each of the limiting members includes at least one second rib portion disposed between the two first rib portions of a respective one of the fastening members. One of the first and second terminal units includes a plurality of parallel contact pins. The other one of the first and second terminal units includes a plurality of pin holes for receiving respectively and removably the contact pins therein to form an electrical connection between the first and second electrical connectors. When the fastening members of the first electrical connector and the limiting members of the second electrical connector are interconnected so that the second rib portion of each of the limiting members is disposed between the first rib portions of the respective one of the fastening members, each of the biasing members biases the respective one of the fastening members to move relative to the first housing in an axial direction of the pins so as to press one of the first rib portions of the respective one of the fastening members against the second rib portion of the respective one of the limiting members, thereby arresting movement of the fastening members toward and away from the limiting members.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
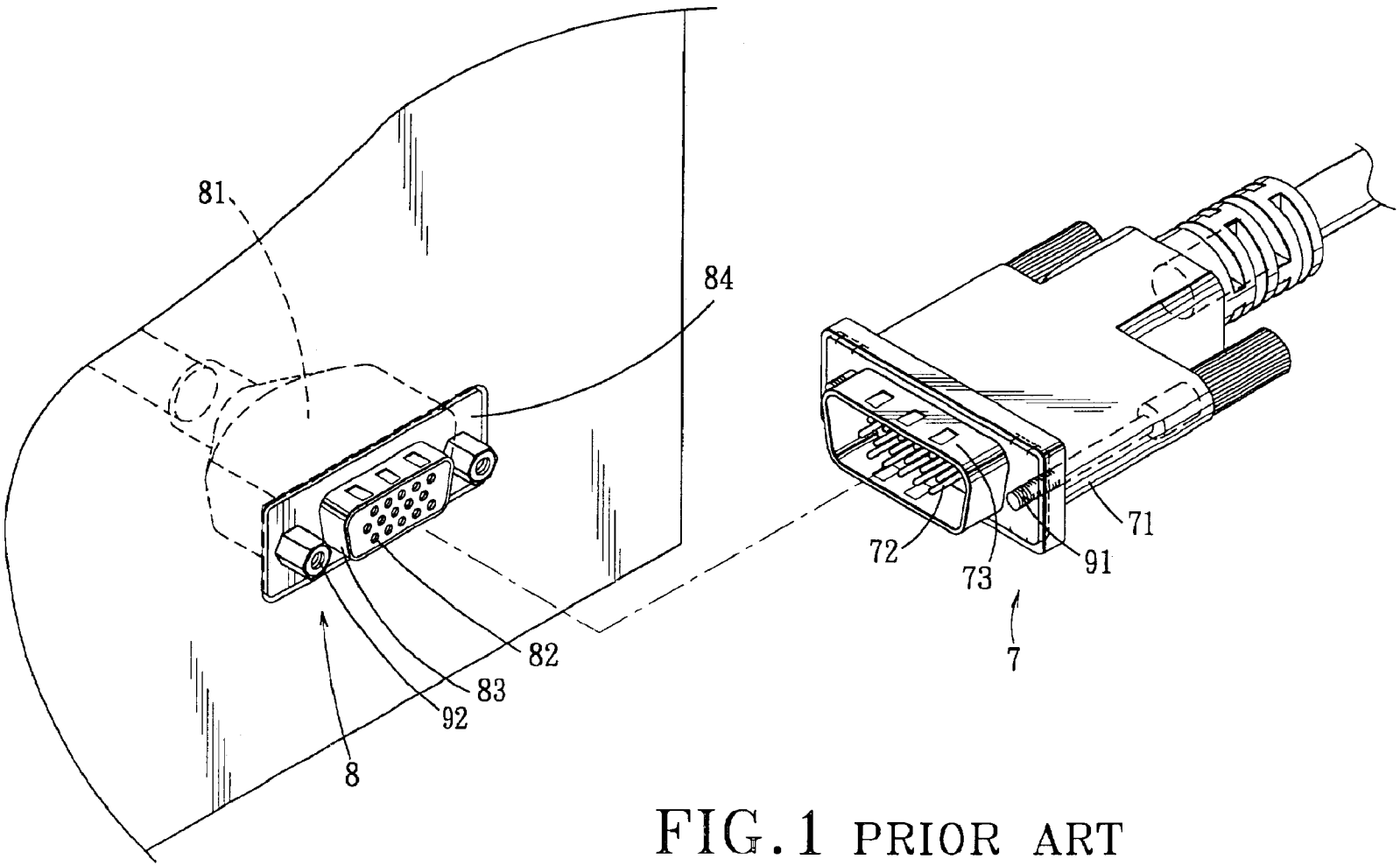
FIG. 1 PRIOR ART
FIG. 1 is a partly exploded perspective view of a conventional electrical connector assembly.

Before the present invention is described in greater detail, it should be noted that like elements are denoted by the same reference numerals throughout the disclosure.

Figure 2:
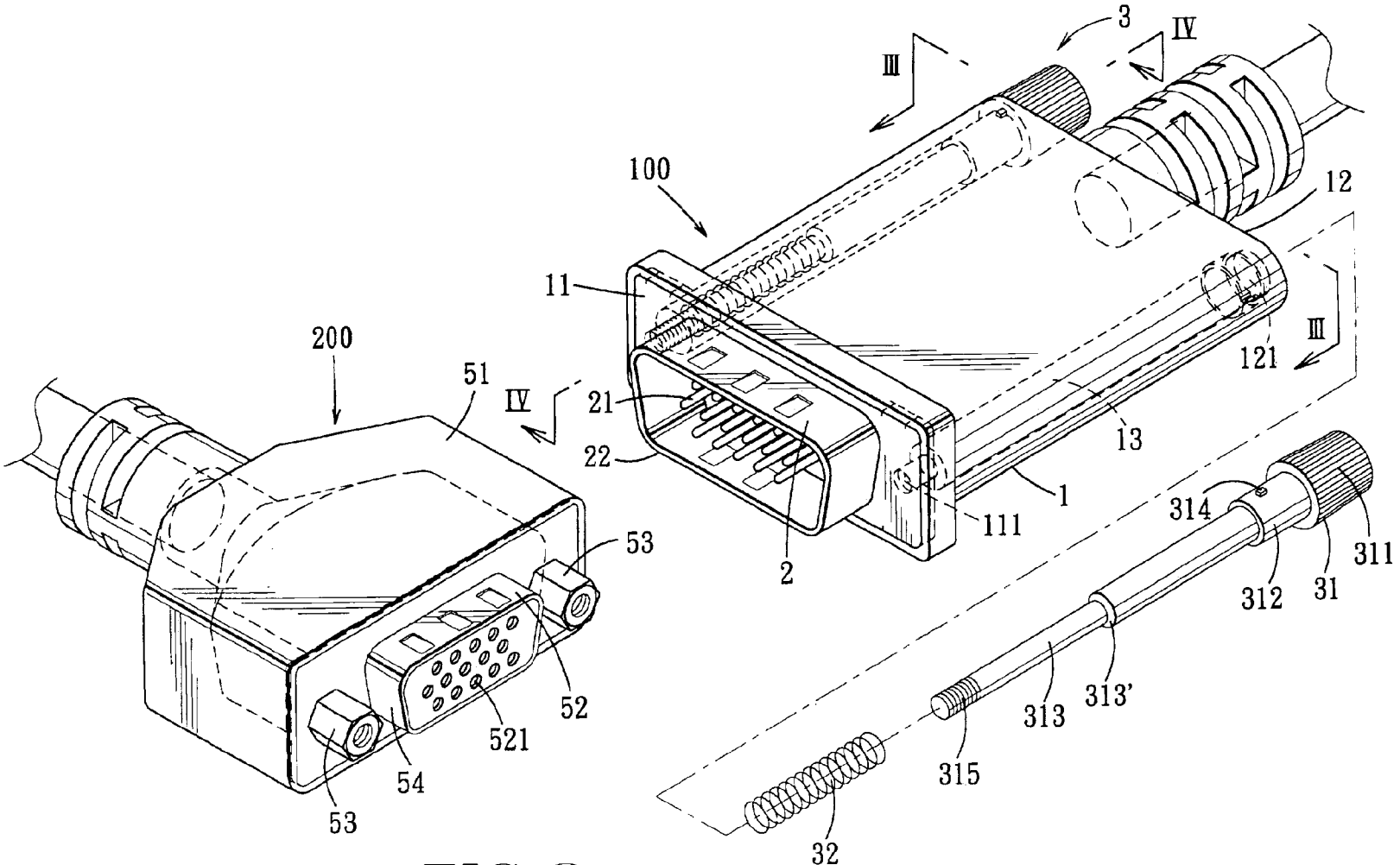
FIG. 2 is a partly exploded perspective view of the first preferred embodiment of an electrical connector assembly according to the present invention.
Figure 3:
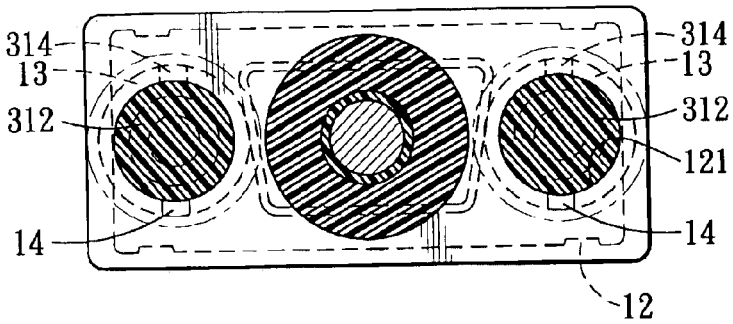
FIG. 3 is a sectional view of the first preferred embodiment, taken along line III—III of FIG. 2.

Referring to FIGS. 2 and 3, the first preferred embodiment of an electrical connector assembly according to the present invention is shown to comprise a first electrical connector 100 and a second electrical connector 200.

The first electrical connector 100 has a first housing 1, a first terminal unit extending outwardly from the first housing 1, and a fastening device 3. The first housing 1 is made of an insulating material, and has a front end wall 11, a rear end wall 12 opposite to the front end wall 11, two first holes 111 formed through the front end wall 11, two second holes 121 formed through the rear end wall 12, and two passages 13, each of which is in communication with a respective one of the first holes 111 and a respective one of the second holes 121 and has two ends that are defined by the front and rear end walls 11, 12, respectively. Each of the second holes 121 is formed with an extension portion 14 (see FIG. 3) that extends radially and outwardly therefrom. Each of the passages 13 has a diameter larger than those of the first and second holes 111, 121.

The first terminal unit 2 includes a plurality of parallel contact pins 21, and an annular first metal shield 22 surrounding the contact pins 21.

The fastening device 3 includes two fastening members 31 that are disposed on the first housing 1 and that are located on two sides of the first terminal unit 2, and two biasing members 32, each of which is disposed between the first housing 1 and a respective one of the fastening members 31. The fastening members 31 and the biasing members 32 are received in the passages 13.

Figure 4:
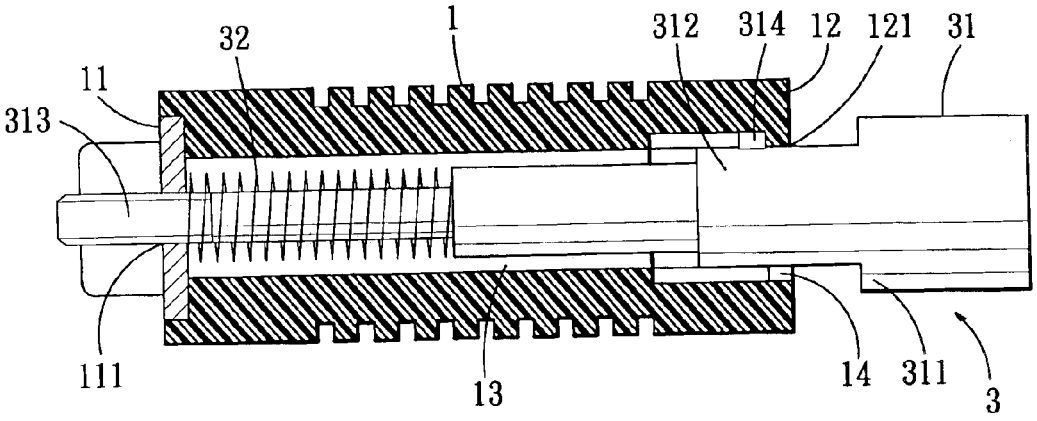
FIG. 4 is another sectional view of the first preferred embodiment, taken along line IV—IV of FIG. 2.

Referring to FIG. 4, in combination with FIG. 3, each of the fastening members 31 is formed with a radially and outwardly extending integral projection 314 that is disposed in the respective one of the passages 13 and that is pressed rearwardly by the respective one of the biasing members 32 against the rear end wall 12 so as to prevent removal of each of the fastening members 31 from the first housing 1. The fastening members 31 are rotatable within the passages 13 so as to align the projections 314 respectively with the extension portions 14 of the second holes 121, thereby permitting removal of the fastening members 31 from the first housing 1 through the second holes 121. Each of the fastening members 31 has a diameter that is reduced gradually from a rear end to a front end to form a large-diameter rear rod portion 311, an intermediate rod portion 312, a small-diameter front rod portion 313, and a shoulder 313' defined between the front and rear rod portions 313, 312. The rear rod portion 311 of each fastening member 31 has a diameter substantially larger than that of the respective one of the second holes 121, and is disposed outwardly of the respective second hole 121. The projections 314 are formed respectively on the intermediate rod portion 312 proximate to the respective rear rod portion 311. The front rod portion 313 of each fastening member 31 has a diameter substantially smaller than that of the respective one of the first holes 111 in the front end wall 11, and an external thread 315 (see FIG. 5) at a front end thereof. The external thread 315 of each fastening member 31 is formed with a plurality of first rib portions 3151 (see FIG. 5). Each adjacent pair of the first rib portions 3151 defines a pitch.

In this embodiment, each of the biasing members 32 is constructed as a coiled compression spring, and has one end pressing against the front end wall 11 of the first housing 1, and the other end pressing against the shoulder 313' of the respective one of the fastening members 31 so as to bias the respective one of the fastening members 31 rearwardly away from the second electrical connector 200.

The second electrical connector 200 is disposed in front of and is connected electrically to the first electrical connector 100. The second electrical connector 200 is constructed in a known manner, and has a second housing 51, a second terminal unit 52 that extends outwardly from the second housing 51 and that is connected electrically and removably to the first terminal unit 2, and two limiting members 53 disposed on the second housing 51 and located on two sides of the second terminal unit 52. The second terminal unit 52 includes an annular second metal shield 54, on which the first metal shield 2 of the first electrical connector 100 is sleeved in a known manner so as to prevent electromagnetic interference, and a plurality of pin holes 521 formed in the second terminal unit 52 for insertion of the contact pins 21 therein to form an electrical connection between the first and second electrical connectors 100, 200. Each of the limiting members 53 has an internal thread 531 at a rear end thereof. The internal thread 531 of each limiting member 53 is formed with a plurality of second rib portions 5311 (see FIG. 5), each of which is disposed between two adjacent first rib portions 3151 of the external thread 315 of a respective one of the fastening members 31. Each adjacent pair of the second rib portions 5311 defines a pitch.

Figure 5:
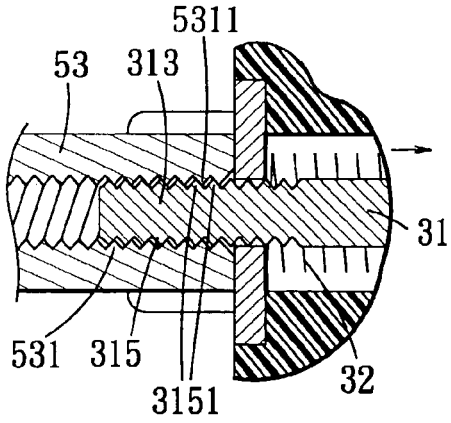
FIG. 5 is a fragmentary sectional view of the first preferred embodiment, illustrating how a biasing member biases a fastening member to press a left one of two adjacent first rib portions of the fastening member against a second rib portion of a limiting member, which is disposed between the first rib portions.

Referring to FIG. 5, when the first terminal unit 2 of the first electrical connector 100 and the second terminal unit 52 of the second electrical connector 200 are interconnected, and when an additional forward push is exerted to the rear rod portions 311 so as to connect threadedly and respectively the front rod portions 313 of the fastening members 31 to the limiting members 53 of the second electrical connector 200, each of the second rib portions 5311 at a rear end of the internal thread 531 of each of the limiting members 53 is disposed between two adjacent first rib portions 3151 of the external thread 315 of the respective one of the fastening members 31. When the front rod portions 313 are not completely threaded to the limiting members 53, each of the biasing members 32 biases the respective one of the fastening members 31 to move rearwardly within the respective one of the passages 13 in an axial direction of the pins 21 so as to press a left one of each adjacent pair of the first rib portions 3151 at a front end of the external thread 315 of the respective one of the fastening members 31 against one right second rib portion 5311 of the respective one of the limiting members 53, that is disposed between the adjacent pair of the first rib portions 3151, thereby arresting movement of the fastening members 31 toward and away from the limiting members 53, and thereby producing a good fixing effect between the first and second electrical connectors 100, 200. Thus, the need to completely thread the front rod portions 313 of the fastening members 31 with the limiting members 53 of the second electrical connector 200 can be dispensed herewith. Moreover, the conventional structure of the limiting members 53 does not have to be altered in order to obtain a quick fixing and releasable connection between the front rod portions 313 and the limiting members 53, thereby resulting in a cost-effective electrical connector assembly.

Figure 6:
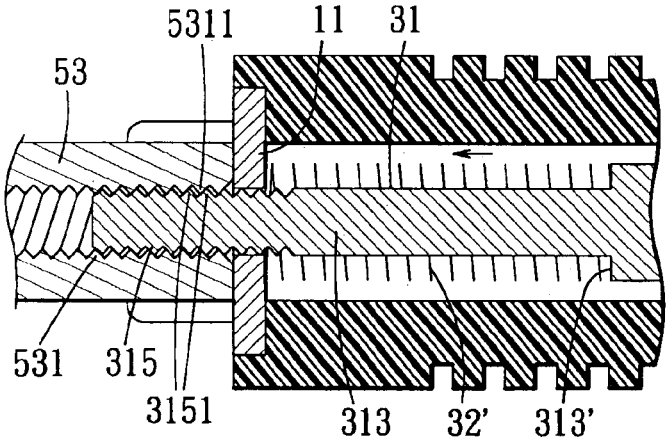
FIG. 6 is a fragmentary sectional view of the second preferred embodiment of an electrical connector assembly according to the present invention, illustrating how a biasing member biases a fastening member to press a right one of two adjacent first rib portions of the fastening member against a second rib portion of a limiting member, which is disposed between the first rib portions.

Referring to FIG. 6, the second preferred embodiment of the electrical connector assembly according to the present invention is shown to be substantially similar to the first preferred embodiment. However, in this embodiment, each of the biasing members 32 is constructed as a coiled tension spring 32', and has one end fastened to the front end wall 11 of the first housing 1, and the other end fastened to the shoulder 313' of the respective one of the fastening members 31 so as to bias each of the fastening members 31 forwardly toward the second electrical connector 200, and so as to press a right one of each adjacent pair of the first rib portions 3151 of the respective one of the fastening members 31 against one left second rib portion 5311 of the respective one of the limiting members 53, that is disposed between the adjacent pair of the first rib portions 3151, thereby arresting movement of the fastening members 31 toward and away from the limiting members 53, and thereby achieving a good fixing effect similar to that of the first preferred embodiment.

Figure 7:
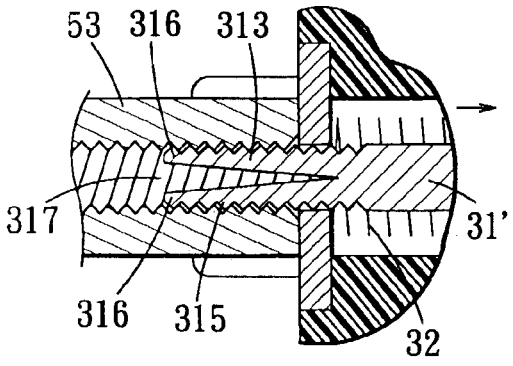
FIG. 7 is a fragmentary sectional view of the third preferred embodiment of an electrical connector assembly according to the present invention, illustrating a fastening member having a front end surface that is formed with a V-shaped groove.

Referring to FIG. 7, the third preferred embodiment of the electrical connector assembly according to the present invention is shown to be substantially similar to the first preferred embodiment. However, in this embodiment, each of the fastening members 31' has a front end surface that is formed with a V-shaped groove 317 which defines two flexible sections 316 so that, during assembly, the external threads 315 of the fastening members 31 can engage the internal threads 531 of the limiting members 53 by forcing the fastening members 31 toward the limiting members 53 in a direction parallel to the pins 21 without performing relative rotation between the fastening members 31 and the limiting members 53.

From the aforementioned description of the preferred embodiments, the electrical connector assembly of the present invention uses the biasing members 32 to bias the fastening members 31 against the limiting members 53 so that both members 31, 53 press against each other, thereby providing a good fixing effect, even if the fastening members 31 are not completely and respectively threaded to the limiting members 53.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

I claim:

1. An electrical connector assembly comprising:

a first electrical connector having a first housing a first terminal unit extending outwardly from said first housing, and a fastening device including two fastening members that are disposed on said first housing and that are located on two sides of said first terminal unit, and two biasing members, each of which is disposed between said first housing and a respective one of said fastening members, each of said fastening members having at least two first rib portions; and a second electrical connector disposed in front of and connected electrically to said first electrical connector, said second electrical connector having a second housing, a second terminal unit that extends outwardly from said second housing and that is connected electrically and removably to said first terminal unit, and two limiting members disposed on said second housing and located on two sides of said second terminal unit, each of said limiting members including at least one second rib portion disposed between said two first rib portions of a respective one of said fastening members, wherein one of said first and second terminal units includes a plurality of parallel contact pins, and the other one of said first and second terminal units includes a plurality of pin holes for receiving respectively and removably said contact pins therein to form an electrical connection between said first and second electrical connectors, wherein when said fastening members of said first electrical connector and said limiting members of said second electrical connector are interconnected so that said second rib portion of each of said limiting members is disposed between said first rib portions of the respective one of said fastening members, each of said biasing members biases the respective one of said fastening members to move relative to said first housing in an axial direction of said pins so as to press one of said first rib portions of the respective one of said fastening members against said second rib portion of the respective one of said limiting members, thereby arresting movement of said fastening members toward and away from said limiting members, and wherein said first housing has a front end wall, a rear end wall opposite to said front end wall, two first holes formed through said front end wall, two second holes formed through said rear end wall, and two passages, each of which is in communication with a respective one of said first holes and a respective one of said second holes and has two ends that are defined by said front and rear end walls, respectively, each of said passages having a diameter larger than those of said first and second holes, said fastening members and said biasing members being received in said passages, each of said second holes being formed with an extension portion that extends radially and outwardly therefrom, each of said fastening members being formed with a radially and outwardly extending integral projection that is disposed in the respective one of said passages and that is pressed rearwardly by the respective one of said biasing members against said rear end wall so as to prevent removal of each of said fastening members from said first housing, said fastening members being rotatable within said passages to align said projections respectively with said extension portions of said second holes, thereby permitting removal of said fastening members from said first housing through said second holes.

2. The electrical connector assembly as claimed in claim 1, wherein each of said fastening members is formed with a shoulder, and each of said biasing members is constructed as a coiled compression spring, and presses against said front end wall of said first housing at one end, and against said shoulder of the respective one of said fastening members at the other end so as to bias said fastening members rearwardly away from said second electrical connector.

* * * * *